US005864973A

United States Patent [19]

Cole

[11] Patent Number: 5,864,973

[45] **Date of Patent: *Feb. 2, 1999**

[54] 3-D GREETING CARD

[75] Inventor: Jeffrey Charles Cole, Denver, Colo.

[73] Assignee: Kenzie Company, L.L.C., Denver, Colo.

[ * ] Notice: The terminal 13 months of this patent has been disclaimed.

[21] Appl. No.: 250,365

[22] Filed: May 27, 1994

[51] Int. Cl.[6] ..... A63H 33/00

[52] U.S. Cl. ..... 40/124.09; 40/124.11; 40/124.08; 40/427; 446/219; 273/157 R

[58] Field of Search ..... 40/124.1, 427, 40/900, 124.09, 124.08, 124.11; 446/219; 359/856; 273/157 R

[56] References Cited

U.S. PATENT DOCUMENTS

| | | | |
|---|---|---|---|
| 169,882 | 11/1875 | Adams | 446/219 X |
| 1,345,017 | 6/1920 | Goodman . | |
| 2,565,553 | 8/1951 | Foley . | |
| 2,984,920 | 5/1961 | Acosta et al. . | |
| 3,503,147 | 3/1970 | Herrin et al. . | |
| 3,834,051 | 9/1974 | Barnes, Jr. . | |
| 4,222,189 | 9/1980 | Kamei . | |
| 4,259,808 | 4/1981 | Oakes | 446/219 X |
| 4,487,590 | 12/1984 | Becker et al. . | |
| 4,500,088 | 2/1985 | Lasky . | |
| 4,613,128 | 9/1986 | Lasky . | |
| 4,854,591 | 8/1989 | Setteducoti | 273/157 R |
| 4,952,004 | 8/1990 | Baird et al. | 359/856 |
| 4,989,355 | 2/1991 | Thomas . | |
| 5,261,172 | 11/1993 | Rowley . | |
| 5,293,706 | 3/1994 | Wood | 40/124.1 |

*Primary Examiner*—Cassandra H. Davis
*Attorney, Agent, or Firm*—Rick Martin

[57] ABSTRACT

An improvement is added to the existing concept of using a mirrored surface to reflect a half symmetrical image which is printed on an adjoining card. The improvement is adding a perspective drawing of a related vertical object on the mirrored surface. The vertical object is positioned to interact in a coherent manner with the reflection of the half symmetrical image. The interaction between the images provides an enhanced 3–D phenomena. Additionally objects such as a ball seem to float out of the 3–D image. One embodiment further adds a movable tab which allows modifying the overall image. The invention can be used for greeting cards, books, baseball hat peaks, and assorted novelty items.

3 Claims, 6 Drawing Sheets

3-D GREETING CARD

FIELD OF INVENTION

The present invention relates to 3–D paper images which serve as illustrations on pop out cards, children's 3–D books, baseball caps, and methods to enhance the 3–D phenomena.

BACKGROUND OF THE INVENTION

We are all fascinated by 3–D images created by mirrors. U.S. Pat. No. 1,346,017 (1920) to Goodman discloses a novel children's book which uses a mirror mounted on the rear cover and held perpendicularly to the pages of the book. Each page is printed with a symmetrical half figure. The symmetry of the half figure is based on a centerline of the figure which corresponds to the lower edge of the mirror. Thus, the mirror reflects the half figure thereby providing the missing half of the half figure. A 3–D effect is created for the viewer. Additionally Goodman teaches the use of reversed letters on the book pages which are readable in the mirror.

Other relevant prior art patents are noted below.

U.S. Pat. No. 2,565,553 (1951) to Foley discloses a three dimension picture device using a plurality of curved concentric transparent sheets.

U.S. Pat. No. 3,834,051 (1974) to Barnes, Jr. et al. discloses a curved mirror which reflects a normal picture of a distorted flat image.

U.S. Pat. No. 4,222,189 (1980) to Kamei discloses a medallion having a mirror beneath the embossed image.

U.S. Pat. No. 4,487,590 (1984) to Becker et al. discloses a children's book having cut-outs for the child's hands around a steering wheel.

U.S. Pat. No. 5,261,172 (1993) to Rowley discloses a 3–D greeting card wherein a front panel contains a scene. A shelf extends from the bottom of the front panel and supports a 3–D figure such as a mouse which fits into the scene of the front panel.

U.S. Pat. No. 4,989,355 (1991) to Thomas discloses a 3–D card using two opposing mirrored surfaces. Each surface has a design drawing on it. These designs interact to form 3–D images.

U.S. Pat. No. 2,984,920 (1961) to Acosta et al. discloses a 3–D card using multiple transparent panels.

U.S. Pat. No. 3,503,147 (1970) to Herrin et al. discloses a 3–D chamber having a transparent front wall and an opaque rear wall. Each wall has a coordinated drawing.

The present invention improves on the Goodman 3–D technique by adding the following three limitations to the half mirror half printed page at a 90° angle technique taught by Goodman. The newly invented limitations embodied in the present invention are:

1. On one side of the folded card there must be a printed half image that is horizontally symmetrical in design usually on a base panel. The printed half image can also be printed on a mirror surface. The printed half image must be an object that is horizontal in nature or commonly recognized as horizontal such as a kitchen floor, table, sidewalk, etc. The printed half image is printed up to a 90° fold line of the card at the line of symmetry.

2. On the other side of the folded card usually on a vertical panel is a perspective drawing of a vertical object(s). The said vertical object could be that of a person, animal, or thing that is commonly seen as standing upright such as a door, wall, fence, person, etc. The perspective drawing is placed on a mirror surface so that the outer contour areas of the perspective drawn objects(s) are surrounded by the reflection of the printed half image from the opposing page. The perspective drawing is printed up to the fold line of the card.

3. There must be a relationship between the full image including the reflection and the half image and the perspective drawing of a vertical object so that interaction occurs in a meaningful coherent fashion that enhances the 3–D phenomena. In cases where the card or book has no base panel but instead has a pair of the 90° hinged vertical panels then the horizontal and vertical rules applied in paragraph 1 above must be reversed.

All symmetrical objects have a line of symmetry but some objects are not symmetrical.

A yet further embodiment teaches the addition of a removable tab which has been printed on both sides. The tab can be placed on the flat horizontal page which contains the printed half image. An example would be a tab of a tricycle which is placed on a sidewalk. On the back side of the tab could be a dog which reflects in the mirror. Thus, the child can creatively change his 3–D picture. Furthermore, the child cannot ruin the pop-up tab by tearing it off of the page which is often the case with traditional pop-up cards.

Yet another feature of the present invention is the creation of forward projecting shadows from the perspective drawing of the vertical object. Thus, a vertical fence post can project a shadow on the printed half image of the horizontal lawn.

In summary, a partial list of the 3–D image enhancing characteristics of the present invention are listed below:

Primarily for sceneries, wherein a 3–D image is created that is very similar to one that is created by the traditional method of using a pop-up figure in front of a mirror. The present invention cannot be destroyed by tearing out a pop-up figure.

At some state of manufacturing a traditional childrens pop-out book, an individual must glue or attach paper articles into the unfinished book. Page after page the pieces must be placed accordingly and properly folded to make certain the book operates as expected. In addition to this, each new book series introduced to the manufacturing system requires new methods of engineering design as well as new tooling for punching, cutting, scoring, etc. After producing a number of these books the dyes begin to wear out and must be replaced.

Therefore, there is a need for book manufacturers to be able to produce a children's book with three dimensional images which look like pop-out features, whereas the book production is completely done by machine from start to finish. The present invention allows only required printing methods of which will not require new tooling or extensive preplanning by artists and engineers after each new series is introduced.

Pop-out pieces which are attached to books are often damaged or separated from the books during normal use. Young children have a tendency to tear and remove pieces. Opening and closing the book pages will sometimes result in pop-out features folding incorrectly or wearing out, causing pieces to be damaged. There is a need in the art for three dimensional books for children having images which look like pop-out features that cannot be separated from the book or damaged during normal use and can be opened and closed without wear or tear.

Ideal for common scenic views with characters of persons, places and things. (Virtual reality comic or cartoons)

Can use only one mirror to create the graphic image. Some two mirror reflections are workable such as a tree with pop outs in the center of the two mirrors.

3–D scenic features are viewable at many different angles. (From side to side and high above)

The cards images can be seen from 30–40 ft. away walking from side to side.

Opens 90° for viewing a scenic feature. Image is not easily noticeable beyond 95° or below 80°. Does not require a gusset to hold the page halves at a specific angle.

By creating a scenic picture style for new ideas, there are endless possibilities and combinations of illustrations to develop a trend or continuation of comic/cartoon story telling.

A single light source located behind the viewer will create a shadow in the foreground adding realism to the scenic effects.

Removable pop-out figures reflect before the mirror to increase the possible combinations and realism of new effects, such as a Jack in the Box. Non-removable pop-out figures are also workable.

The three steps formula is new.

In the event that the cards/books are opened in a horizontal position, the pop-out features appear to be standing straight up.

It is possible and practical to manufacture the 3–D images as small as a postage stamp.

Able to produce small books and standard mailing postcards.

Able to reflect words, word phrases and symbols that are symmetrical in design.

SUMMARY OF THE INVENTION

The main object of the present invention is to provide a three step process and apparatus which centers on a painted vertical object imposed on a single mirrored surface in juxtaposition with a symmetrical and coordinated half image. The result is an enhanced 3–D phenomena.

Another object of the present invention is to add a pop-up figure to foreground of the invention noted above.

Yet another object of the present invention is to modify the aforementioned pop-up figure to a removable tab having a figure painted on both sides.

Other objects of this invention will appear from the following description and appended claims, reference being had to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
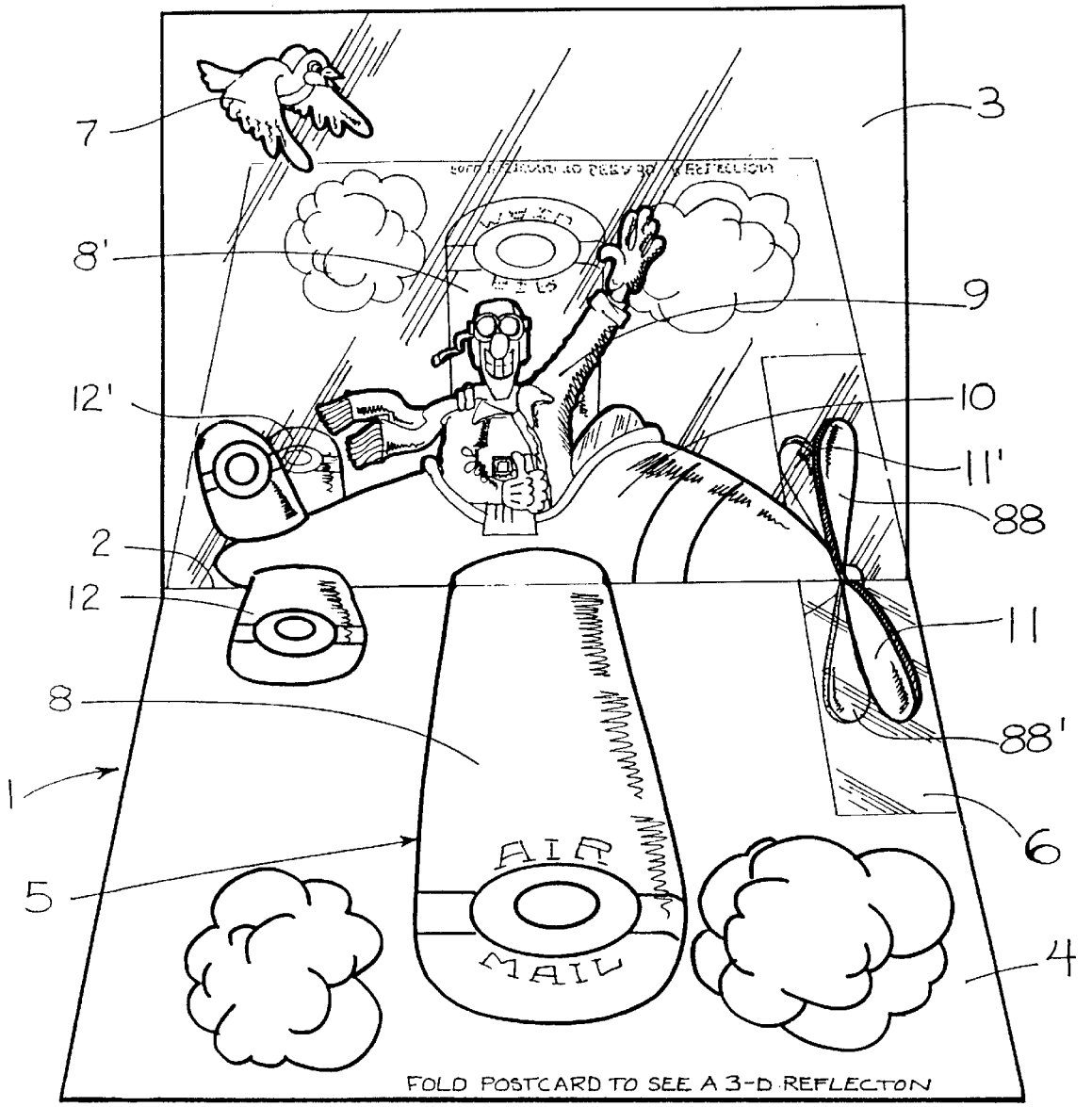
FIG. 1 is a top perspective view of a postcard embodiment of the present invention having a pilot as the prominent vertical image painted on the mirror surface.

Referring first to FIG. 1 a postcard 1 has a centerline fold 2. The mirrored surface 3 is shown at approximately a 90° angle to the printed surface 4. Printed surface 4 contains a symmetrical printed half image 5 which is printed up to the fold line 2 of the postcard 1. The symmetrical printed half image 5 is horizontal in nature having a prominent airplane wing 8 set in a sky scene. Optionally there is shown a partial mirrored surface 6 on the printed surface 4. The bird 7 which is printed on the mirrored surface 3 appears to be floating without any visible attachment to the postcard 1. The airplane wing 8 reflects into the mirrored surface 3 and displays as reflection 8'. Reflection 8' is located behind the printed vertical object, the pilot 9. Additional vertical object, airplane 10, is also printed on the mirrored surface 3.

For the drawing convention of this patent all numbers appearing as a prime, such as propeller 11', represent a reflection of a printed object from the opposing page. The horizontal stabilizer 12 and propeller 11 reflect as 12' and 11' respectively. It should be noted that the ideal viewing position for the maximum 3–D phenomena is at about a 45° angle above the postcard. A single point light source such as a bulb B will enhance a shadow effect as better seen in FIGS. 3,4.

The method of producing the enhanced 3–D image depicted in FIG. 1 is summarized below:

Referring first to FIG. 1 a postcard 1 has a centerline fold 2. The mirrored surface 3 is shown at approximately a 90° angle to the printed surface 4. Printed surface 4 contains a symmetrical printed half image 5 which is printed up to the fold line 2 of the postcard 1. The symmetrical printed half image 5 is horizontal in nature having a prominent airplane wing 8 set in a sky scene. Optionally there is shown a partial mirrored surface 6 on the printed surface 4. The bird 7 which is printed on the mirrored surface 3 appears to be floating without any visible attachment to the postcard 1. The airplane wing 8 reflects into the mirrored surface 3 and displays as reflection 8'. Reflection 8' is located behind the printed vertical object, the pilot 9. Additional vertical object, airplane 10, is also printed on the mirrored surface 3.

For the drawing convention of this patent all numbers appearing as a prime, such as propeller 11', represent a reflection of a printed object from the opposing page. The horizontal stabilizer 12 and propeller 11 reflect as 12' and 11' respectively.

Figure 2:
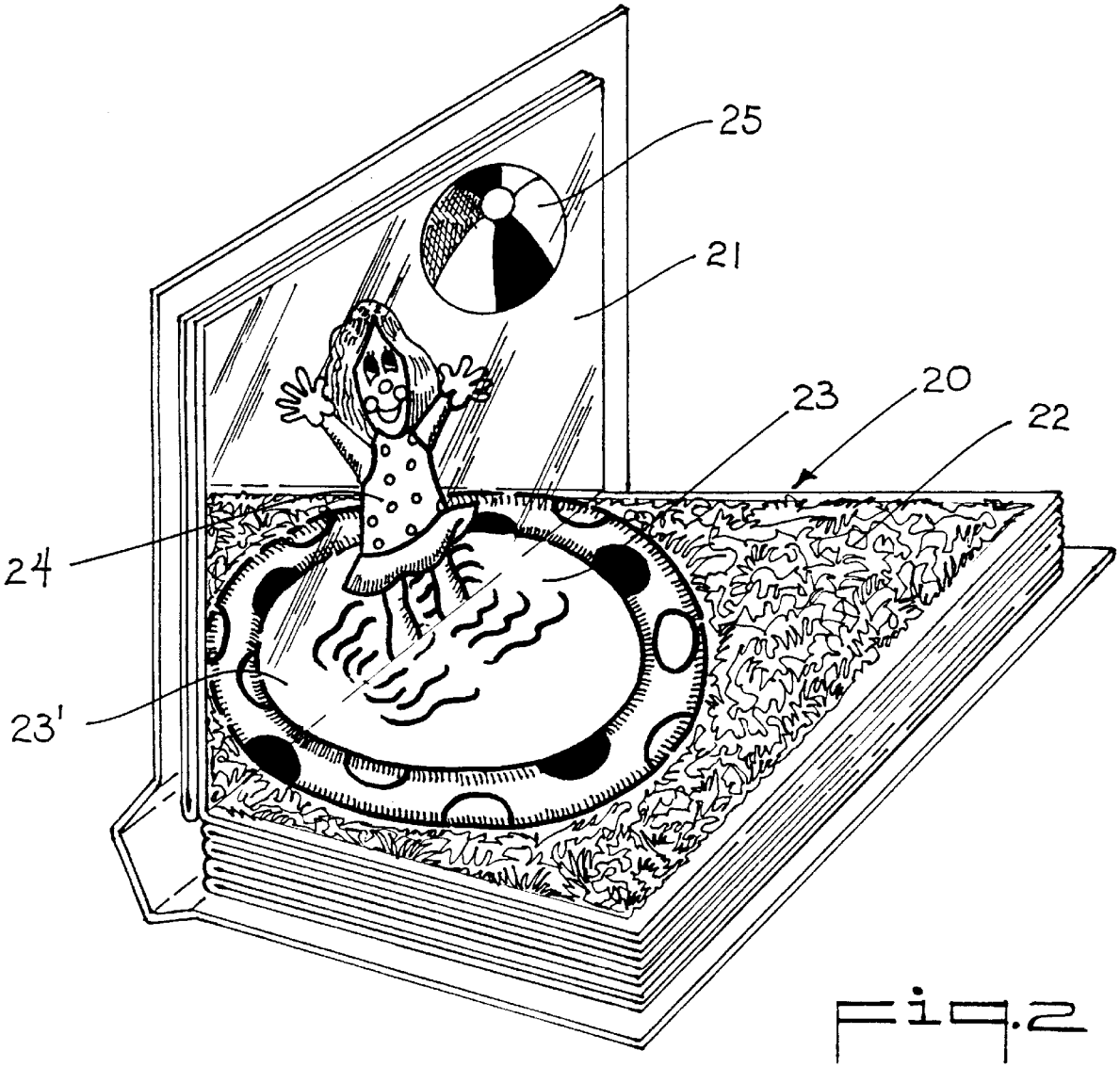
FIG. 2 is a top perspective view of a children's book embodiment of the present invention having a girl as the prominent vertical image painted on the mirror surface.

Referring next to FIG. 2 a children's book 20 contains a mirrored page 21 held at approximately a 90° angle to a printed page 22. Printed page 22 had a symmetrical half image which is horizontal in nature, pool 23. The perspective drawing of a vertical object, girl 24, is printed on the mirrored page 21. The ball 25 is also printed on the mirrored page 21. The overall relationship of the pool 23, the girl 24, and the ball 25 interact in a coherent fashion so as to produce an enhanced 3–D image.

Figure 3:
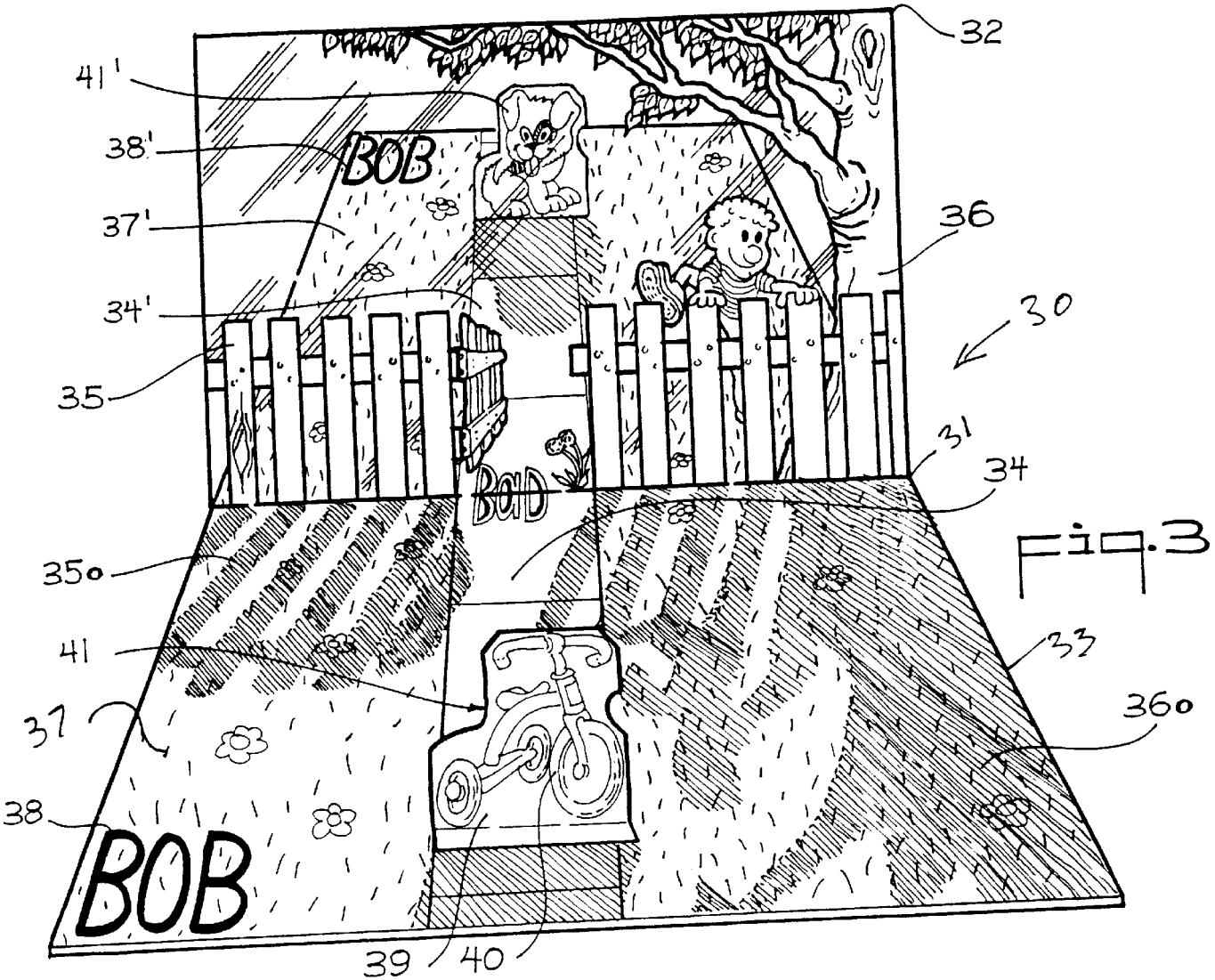
FIG. 3 is a top perspective view of a greeting card embodiment of the present invention having fence posts as the prominent vertical images painted on the mirror surface as well as a pop-up tricycle tab.

Referring next to FIG. 3 a greeting card 30 has a mirrored inside back page 32 and a printed inside front page 33. The symmetrical half image of the sidewalk 34 is horizontal in nature and stops at the fold line 31. The perspective drawing of the vertical objects, the fence 35 and the tree 36, are printed on the mirrored inside back page 32. The fence 35 and tree 36 are surrounded by reflection 37' of the half image yard scene 37.

The symmetrical letters BOB 38 are rendered on the printed inside front page 33. They reflect in readable fashion as BOB 38'. A folded pop-up tab 39 has a front side picture of tricycle 40 and a back side picture of dog 41, as can be seen as reflection 41'. The further enhancement of the 3–D image is created by tree shadow 360 and fence shadow 350 which are created from a light source (not shown) behind the viewer.

Figure 4:
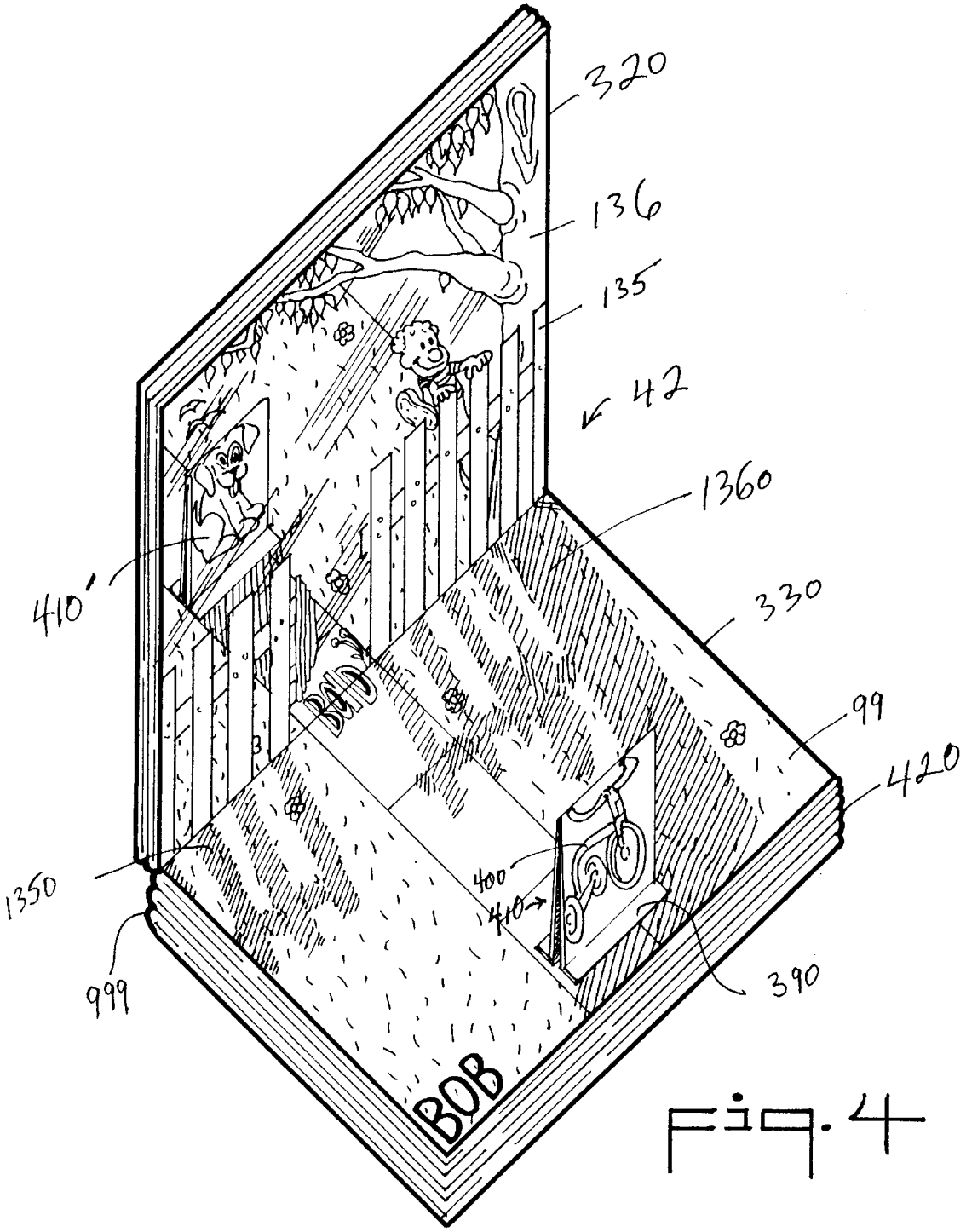
FIG. 4 is a top perspective view of a children's book embodiment of the present invention with the same scene as FIG. 3, but having a removable pop-up tricycle tab.

In FIG. 4 is shown a children's book 42 having a similar scene as that in FIG. 3. The pages 420 can have many different scenes. The pages 420 are joined at binding 999. The mirrored page 320 faces the printed page 330. The tree 136 casts a shadow 1360. The fence 135 casts a shadow 1350. The tab 390 is movable. The child can create his own scenes. The dog 410 is reflected as 410'. The tricycle 400 can be rolled across the lawn 99. It should be noted that this children's book 42 can be manufactured by merely printing the various scenes. No punching, hand folding, or gluing operations are necessary. The tab 390 can even be used on several scenes and interchanged with other tabs (not shown).

Figure 5:
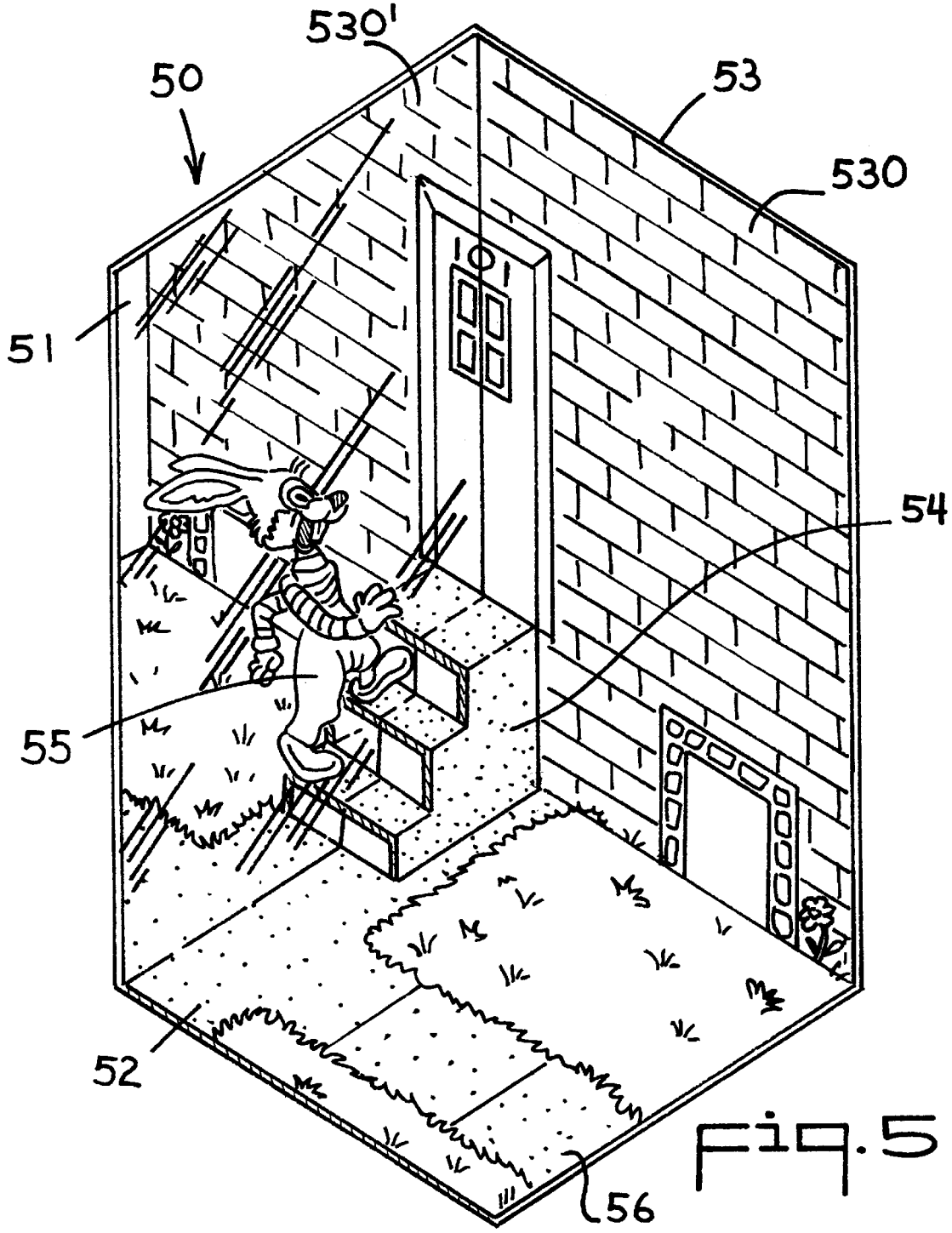
FIG. 5 is a top perspective view of a three sided greeting card embodiment having pop-up stairs.

Referring next to FIG. 5 a three sided greeting card 50 is shown. The mirrored back page 51 has the vertical object, rabbit 55, printed on it. The printed page 52 has the horizontal sidewalk 56 printed thereon. The pop-up stairs 54 are reflected as 54'. The third page 53 has a coordinated and vertically symmetrical design 530 which also reflects as 530' in the mirrored back page 51. The number 101, the door, the window , the brick and the pop-out stairs are all vertically symmetrical as shown. The greeting card 50 folds flat in a known manner.

Figure 6:
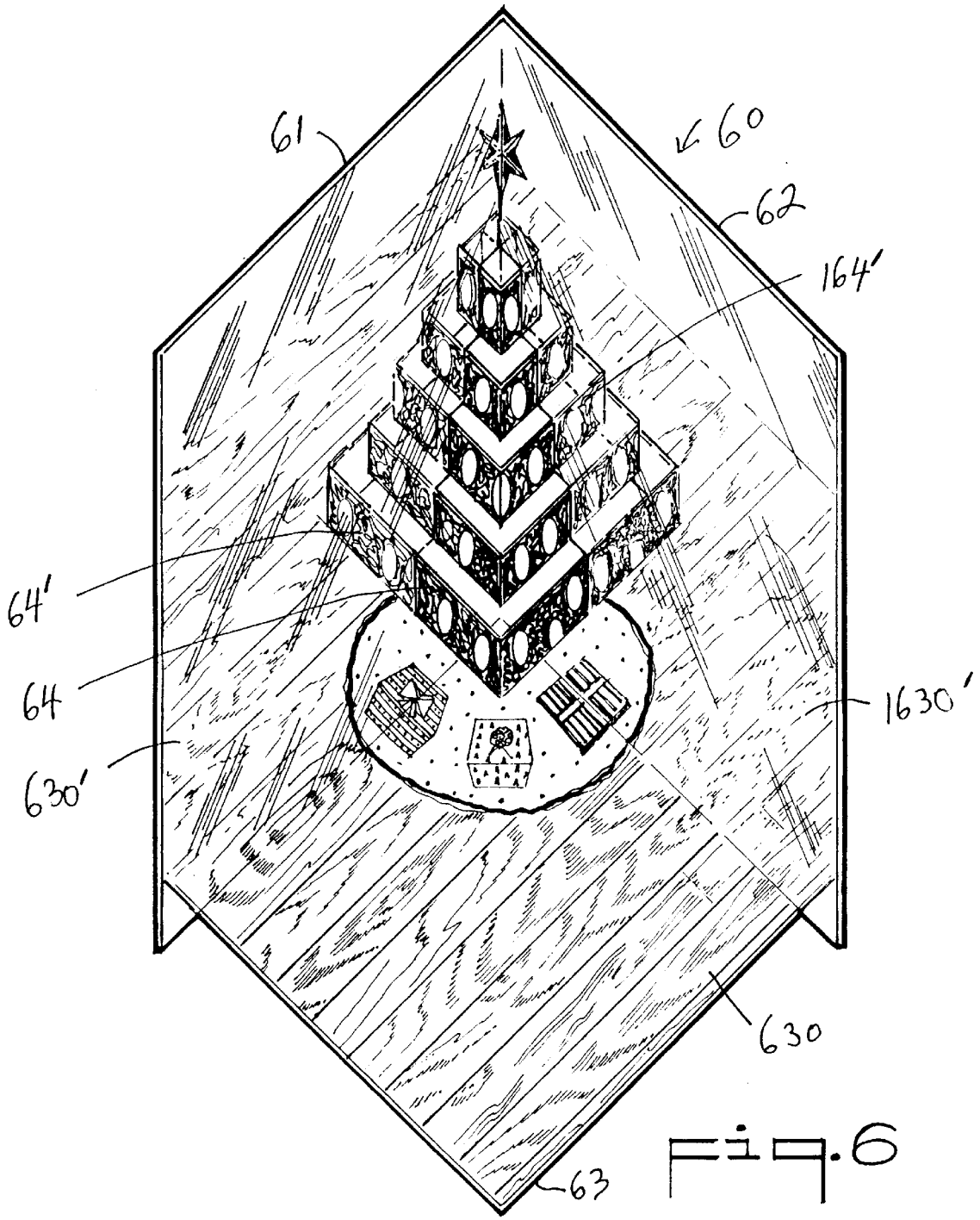
FIG. 6 is a top perspective view of a three sided greeting card wherein corner pop-up tree branches form the prominent vertical image on the mirror surface.

Referring last to FIG. 6 a three sided greeting card 60 does not use any printing directly on the two mirrored pages 61, 62. Rather, the pop-out panels 64 serve the vertical object for both mirrored pages 61, 62. The printed page 63 has horizontal floor board design 630. It reflects as 630' and 1630'. Pop-out panels 64 reflect as 64' and 164'.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A set of display panels touching along a common line, comprising: a first panel having a horizontally symmetrical half image of a horizontal scene rendered thereon and having peripheral edges; a second panel having a location touching the first panel along the common line, and forming approximately a 90° angle to the first panel; said second panel further comprising a mirrored surface having a vertical object rendered thereon, wherein the horizontal scene is reflected thereon creating a 3–D image; a coherent relationship between a full image created by the horizontally symmetrical half image, its reflection, and the vertical object, thereby enhancing the 3–D image; and said first panel further comprising a pop-out figure which reflects in the second panel and positioned within the peripheral edges of the first panel.

2. A set of display panels touching along a common line, comprising: a first panel having a horizontally symmetrical half image of a horizontal scene rendered thereon and having peripheral edges; a second panel having a location touching the first panel along the common line, and forming approximately a 90° angle to the first panel; said second panel further comprising a mirrored surface having a vertical object rendered thereon, wherein the horizontal scene is reflected thereon creating a 3–D image; a coherent relationship between a full image created by the horizontally symmetrical half image, its reflection, and the vertical object, thereby enhancing the 3–D image; and a movable tab having a figure which reflects in the second panel and positioned within the peripheral edges of the first panel.

3. A set of display panels touching along a common line, comprising: a first panel having a horizontally symmetrical half image of a horizontal scene rendered thereon; a second panel having a location touching the first panel along the common line, and forming approximately a 90° angle to the first panel; said second panel further comprising a mirrored surface having a vertical object rendered thereon, wherein the horizontal scene is reflected thereon creating a 3–D image; a coherent relationship between a full image created by the horizontally symmetrical half image, its reflection, and the vertical object, thereby enhancing the 3–D image; a third panel perpendicular to both the first and the second panels; said third panel having a coordinated scene having a vertically symmetrical object reflecting into the second panel; and said third panel coordinated scene and second panel vertical object each further comprise a pop-out figure.

* * * * *